US008104931B2

(12) United States Patent
Lai et al.

(10) Patent No.: US 8,104,931 B2
(45) Date of Patent: Jan. 31, 2012

(54) ANTI-GLARE INDOOR LAMP

(75) Inventors: Chih-Ming Lai, Miao-Li Hsien (TW); An-Chi Wei, Miao-Li Hsien (TW)

(73) Assignee: Foxsemicon Integrated Technology, Inc., Chu-Nan, Miao-Li Hsien (TW)

( * ) Notice: Subject to any disclaimer, the term of this patent is extended or adjusted under 35 U.S.C. 154(b) by 383 days.

(21) Appl. No.: 12/564,711

(22) Filed: Sep. 22, 2009

(65) Prior Publication Data

US 2010/0135027 A1 Jun. 3, 2010

(30) Foreign Application Priority Data

Nov. 28, 2008 (CN) ..... 2008 1 0305861

(51) Int. Cl.
*F21V 11/00* (2006.01)

(52) U.S. Cl. ..... 362/355; 362/311.02; 362/277; 362/311.14; 362/319; 362/351

(58) Field of Classification Search ..... 362/277, 362/311.02, 311.14, 319, 351, 355
See application file for complete search history.

(56) References Cited

U.S. PATENT DOCUMENTS

| | | | | |
|---|---|---|---|---|
| 1,471,395 | A | 10/1923 | Garwood | |
| 2,063,504 | A * | 12/1936 | Horwitt et al. | 362/320 |
| 2,834,875 | A * | 5/1958 | Grohskopf | 362/322 |
| 5,662,403 | A | 9/1997 | Akashi et al. | |
| 2005/0036322 | A1 * | 2/2005 | Veffer | 362/373 |

FOREIGN PATENT DOCUMENTS

| | | |
|---|---|---|
| TW | 581849 | 4/2004 |
| TW | M343107 | 10/2008 |
| WO | 2008/050444 | 5/2008 |

* cited by examiner

*Primary Examiner* — Stephen F Husar
*Assistant Examiner* — James Cranson, Jr.
(74) *Attorney, Agent, or Firm* — Altis Law Group, Inc.

(57) ABSTRACT

An exemplary anti-glare indoor lamp includes a shade, light source, and an optical sheet. The shade defines a receiving cavity therein and an opening at the bottom of the receiving cavity. The light source is received in the receiving cavity and positioned to emit light toward the opening. The optical sheet is arranged facing the opening and is sized to cover only part of the opening. The optical sheet is configured for reducing the brightness of the light passing therethrough, and is movable to cover a selected part of the opening. Therefore, the light reaching eyes of a user is reduced, and glare is avoided or at least mitigated.

19 Claims, 7 Drawing Sheets

ANTI-GLARE INDOOR LAMP

BACKGROUND

1. Technical Field

The present invention relates to lamps, and particularly to an indoor lamp with anti-glare function.

2. Description of Related Art

Lamps have numerous applications. Indoor lamps are used for a variety of purposes, such as illuminating a book that one wants to read.

Generally, visible light emitted from a lamp falls within a particular luminance range. When the luminance of the light is too low, visibility is impaired. On the other hand, when the luminance is too high, glare also limits visibility. In the latter case, the light may also cause discomfort or pain. Glare can also occur when light reflects from a target object to a person. In this situation, the occurrence of glare varies according to both the amount of luminance and the relative positions of the light source, the target object and the person. Considerable research has been carried out regarding elimination of glare.

An indoor lamp which provides good luminance without glare is desired.

BRIEF DESCRIPTION OF THE DRAWINGS

Many aspects of the present embodiments can be better understood with reference to the following drawings. The components in the drawings are not necessarily drawn to scale, the emphasis instead being placed upon clearly illustrating the principles of the present embodiments. Moreover, in the drawings, all the views are schematic, and like reference numerals designate corresponding parts throughout the several views.

DETAILED DESCRIPTION

Figure 1:
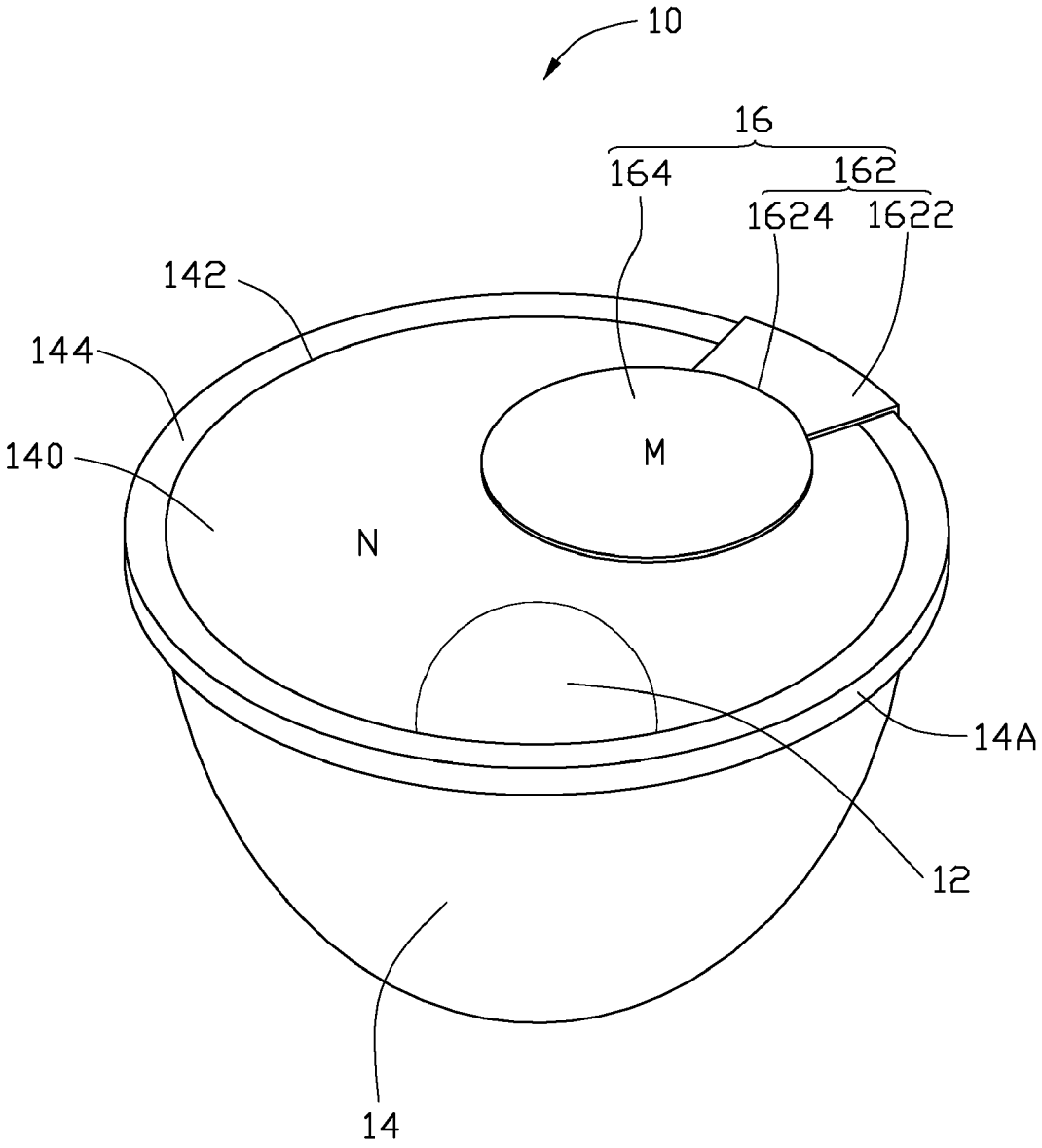
FIG. 1 is an isometric view of a first embodiment of an indoor lamp, showing the indoor lamp inverted.

Referring to FIG. 1, an indoor lamp 10 of a first exemplary embodiment includes a light source 12, a shade 14 and an anti-glare member 16. The indoor lamp 10 has anti-glare function.

The light source 12 can be a single light emitting diode (LED), an LED array, a fluorescent lamp, an incandescent lamp, a gas discharge lamp, or a halogen lamp. In other embodiments, there can be a plurality of light sources 12.

The shade 14 is generally dome-like or cup-like in shape, and tapers in profile from bottom to top. The shade 14 defines a receiving cavity 140 therein. The light source 12 is installed in the receiving cavity 140. The shade 14 has a round opening 142 at the bottom of the receiving cavity 140. A flange portion 14A is formed on an outer surface of a bottom end of the shade 14. The flange portion 14A is annular, and surrounds the round opening 142.

Figure 2:
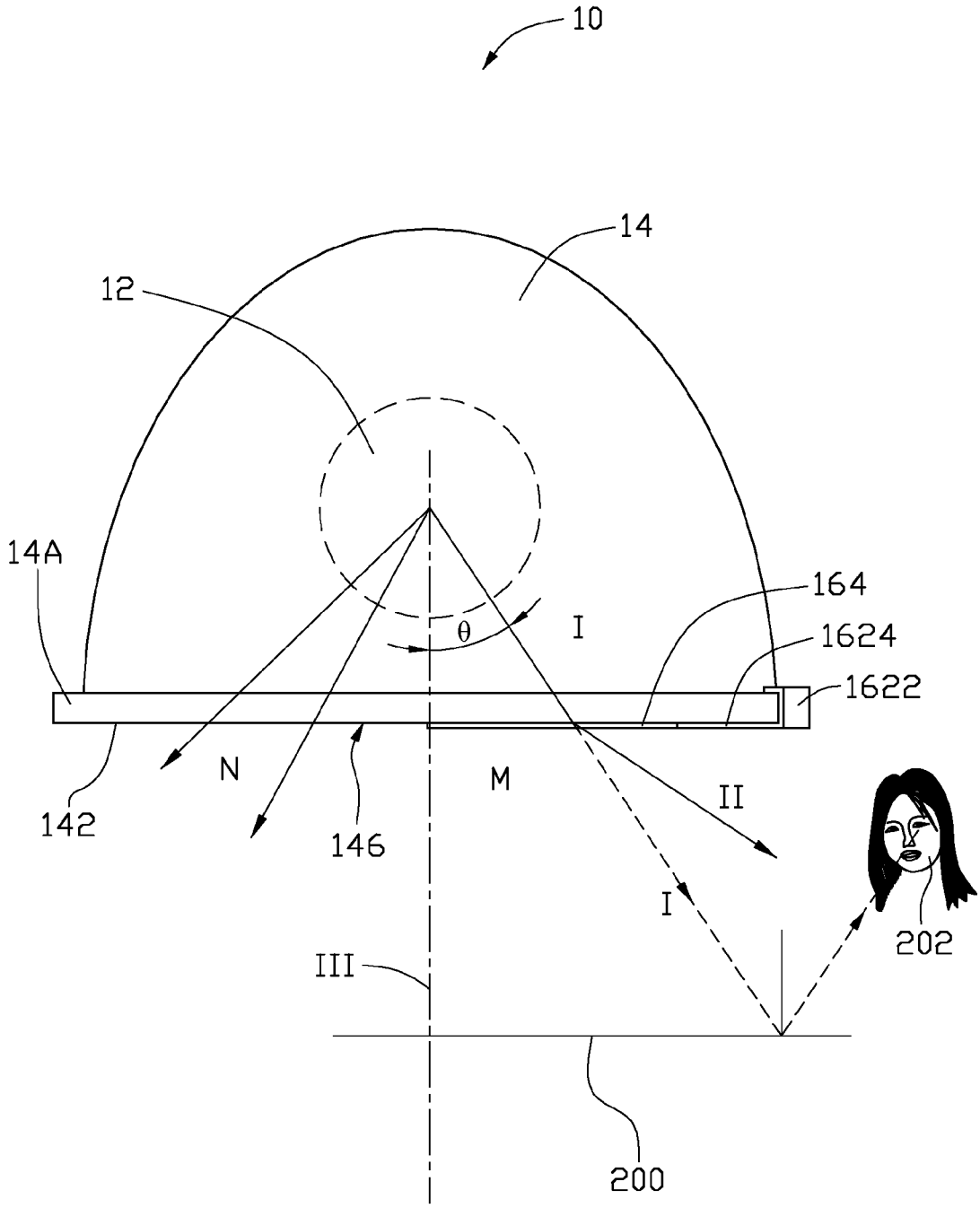
FIG. 2 is a side plan view of the indoor lamp of FIG. 1 together with a desktop and a user, showing optical paths of a light source of the indoor lamp, the optical paths relating to anti-glare function.

Referring also to FIG. 2, the anti-glare member 16 includes a hooked member 162 and an optical sheet 164. The hooked member 162 includes a generally U-shaped portion 1622 and a connection portion 1624. The U-shaped portion 1622 is configured for slidably engaging with the flange portion 14A. That is, the U-shaped portion 1622 is slidable along the flange portion 14A.

The U-shaped portion 1622 extends from an outer side of the connection portion 1624. Preferably, the connection portion 1624 is integrally formed with the U-shaped portion 1622, with the U-shaped portion 1622 and the connection portion 1624 being parts of a single continuous body of material. The connection portion 1624 is parallel to and faces the round opening 142. An inner side of the connection portion 1624 is connected with the optical sheet 164. The position of the optical sheet 164 in the round opening 142 can be changed by sliding the U-shaped portion 1622 along the flange portion 14A.

The optical sheet 164 has an area less than that of the round opening 142. In the illustrated embodiment, a diameter of the optical sheet 164 is less than half a diameter of the round opening 142. The optical sheet 164 is parallel to and faces the round opening 142 and covers a region M thereof. The region of the round opening 142 not covered by the optical sheet 164 is defined as a region N. In this embodiment, the optical sheet 164 is a diffuser.

The indoor lamp 10 is used, for example, with a desktop 200. The indoor lamp 10 is positioned over the desktop 200, and the optical sheet 164 faces the desktop 200. Light emitted from the light source 12 does not directly reach the eyes of a user 202 due to the shade 14. The light emitted from the light source 12 passes through the regions M and N and is then reflected by the desktop 200. In this embodiment, the optical sheet 164 is positioned at a side of the shade 14 adjacent to the user 202.

As shown by the dashed portion of the line I in FIG. 2, in the case where no optical sheet 164 is included in the indoor lamp 10, the light emitted from the light source 12 passes through the region M and is reflected to the eyes of the user 202 by the desktop 200. If the light emitted from the light source 12 is bright, the user 202 is liable to experience glare and accompanying discomfort. As indicated by the continuous line II in FIG. 2, when the optical sheet 164 is included in the indoor lamp 10, the light emitted from the light source 12 passes through region M and is diffused by the optical sheet 164. Thus the brightness of the light reflected by the desktop 200 to the user 202 is reduced, and glare is avoided or at least mitigated. Light passing through the region N is unaltered, and directly illuminates the desktop 200 and surroundings.

Additionally, when the position of the user 202 changes relative to the indoor lamp 10, the position of the optical sheet 164 can be changed accordingly by sliding the U-shaped portion 1622 along the flange portion 14A. For improved anti-glare function, a transmission rate of the optical sheet 164 may be less than 80%, and even less than 60%. An annular end face 144 of the shade 14 at the flange portion 14A defines a reference plane 146. In the illustrated embodiment, the light source 12 is installed in the receiving cavity 140 such that a center axis of the light source 12 is coaxial with a center axis III of the shade 14. The center axis III is perpendicular to the reference plane 146. An angle θ is defined between the center axis III and the continuous portion of the line I. The optical sheet 164 provides effective anti-glare function when the angle θ is in the range from 30° to 75°.

It is to be understood that in alternative embodiments, the optical sheet 164 can be a reflector or a light filter. The light filter can be a neutral density filter or a bandpass filter. The bandpass filter can filter out light with a wavelength in the range from 410 nanometers (nm) to 780 nm. In other alternative embodiments, the optical sheet 164 can be a sheet with an anti-dazzling function.

Figure 3:
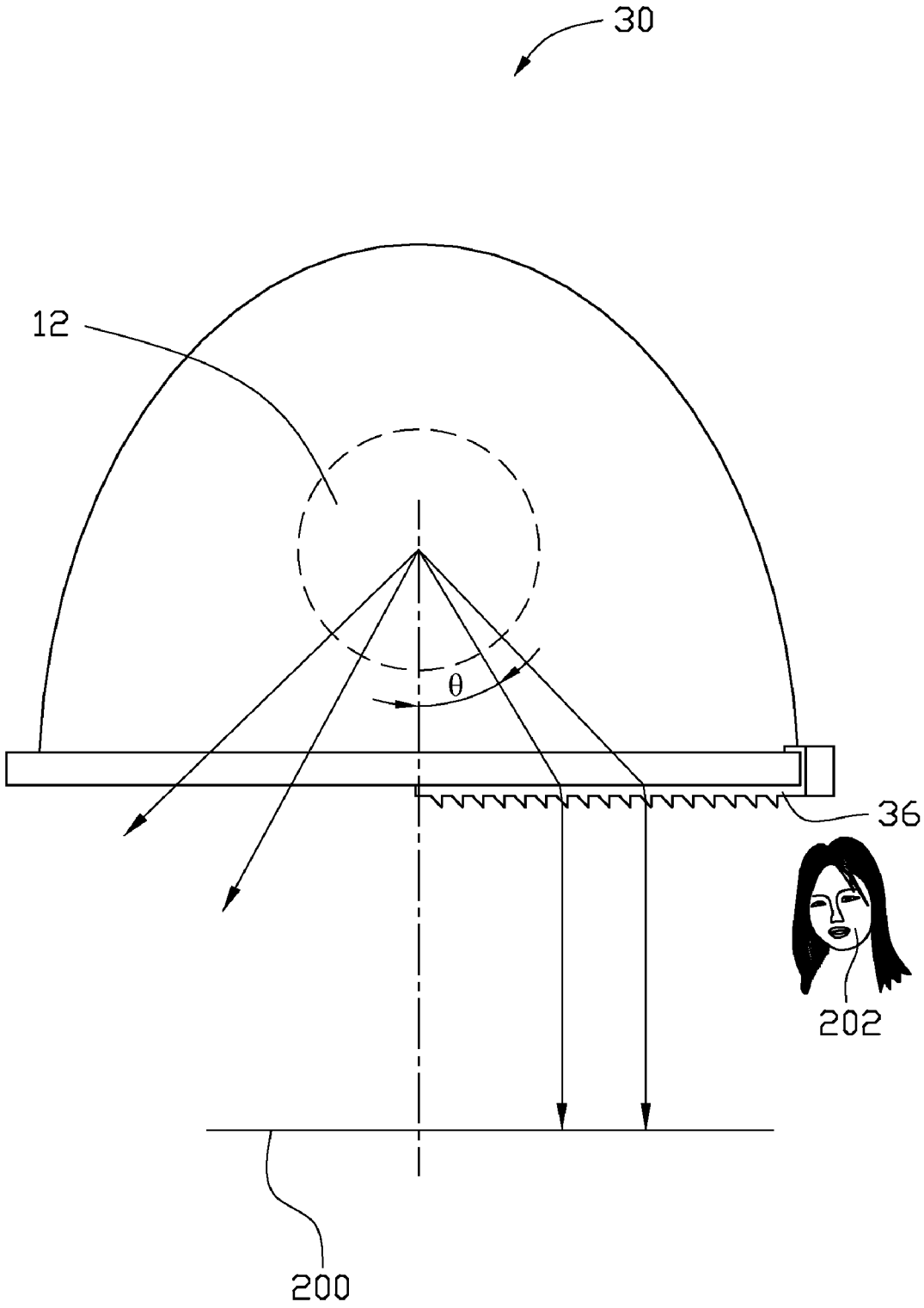
FIG. 3 is similar to FIG. 2, but showing the situation in respect of a second embodiment of an indoor lamp.

Referring to FIG. 3, this shows an indoor lamp 30 of a second exemplary embodiment. The indoor lamp 30 differs from the indoor lamp 10 as follows. A hooked member (not labeled) has a very small connection portion or no connection portion at all. An optical sheet 36 has a diameter that is substantially half a diameter of a round opening (not labeled). A bottom of the optical sheet 36 includes a plurality of parallel prisms. The prisms are spaced apart from one another. Each of the prisms is generally parallel to an imaginary chord defined by a hooked member (not labeled) of the anti-glare member. Each prism is a triangular prism. A side of each prism farthest from a center axis (not labeled) of the shade 14 is substantially parallel to the center axis of the shade 14. Another side of each prism nearest to the center axis of the shade 14 is oblique to the center axis of the shade 14. Light emitted from the light source 12 is refracted by the prisms and thereby deflected from its original paths. Therefore, the light reflected by the desktop 200 to the eyes of the user 202 is reduced, and glare is avoided or at least mitigated.

Figure 4:
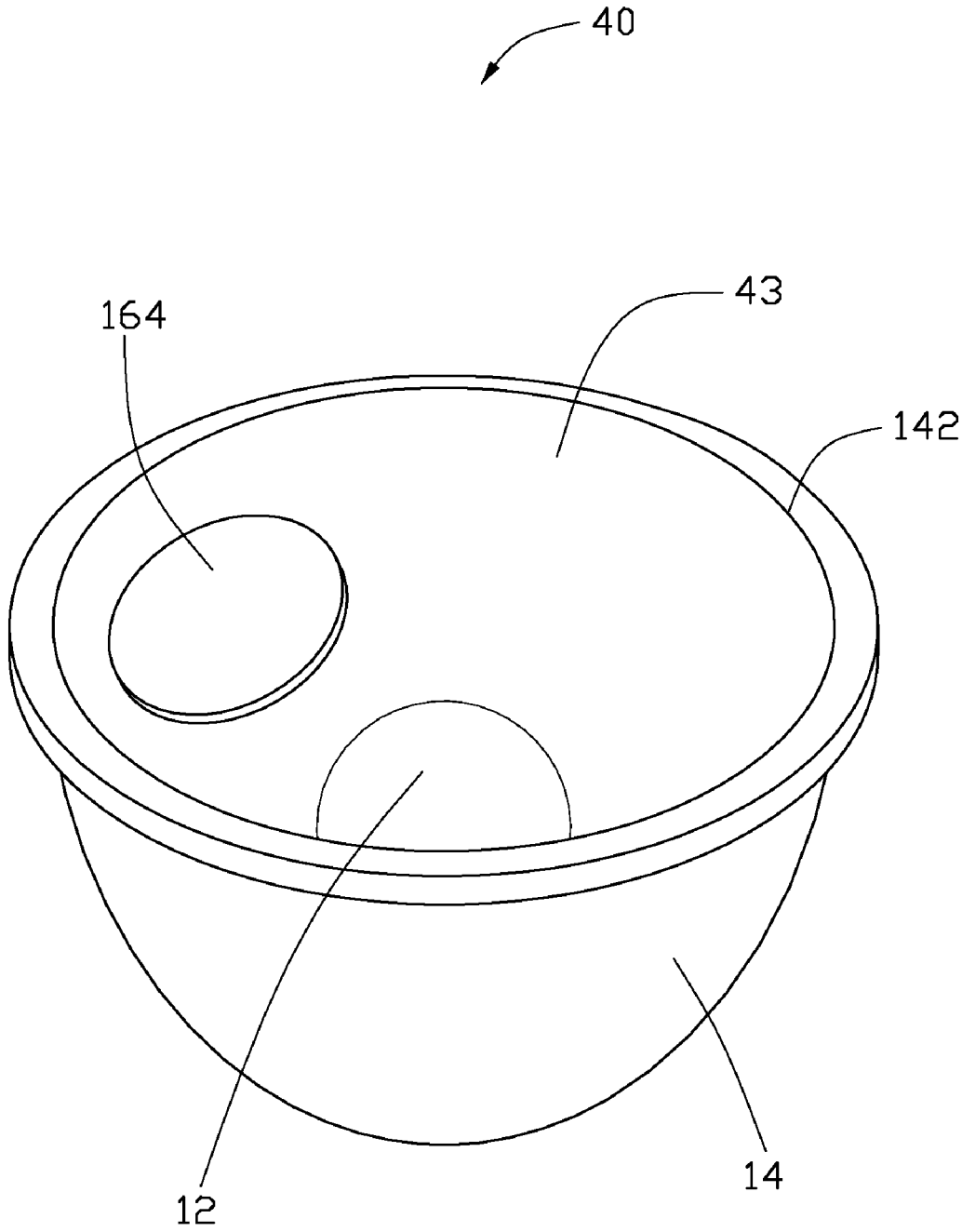
FIG. 4 is an isometric view of a third embodiment of an indoor lamp, showing the indoor lamp inverted.

Referring to FIG. 4, this shows an indoor lamp 40 of a third exemplary embodiment. The indoor lamp 40 differs from the indoor lamp 10 as follows. The hooked member 162 is omitted. The indoor lamp 40 includes a light-pervious cover 43, which has a generally spherical curvature. An imaginary longest chord of the light-pervious cover 43 has a length substantially the same as the diameter of the round opening 142. That is, a circumference of the light-pervious cover 43 is substantially the same as that of the round opening 142. The wall of the shade 14 at the round opening 142 and the light-pervious cover 43 abut each other, with the interface therebetween being sealed. The sealing may be achieved by, e.g., interference fit or applied transparent adhesive. Thereby, the light-pervious cover 43 is fixed to the wall of the shade 14. The light-pervious cover 43 is configured for optically adjusting, that is diverging or converging, the paths of light emitted from the light source 12, and thus adjusting an illumination scope of the light source 12. In the illustrated embodiment, the light-pervious cover 43 is in the form of a meniscus lens that converges the paths of light emitted from the light source 12. The optical sheet 164 is detachably attached to a bottom surface of the light-pervious cover 43, such that a position of the optical sheet 164 relative to the light-pervious cover 43 can be changed according to the position of the user 202. The detachably attaching may be achieved by. e.g., applied transparent undry-glue.

Figure 5:
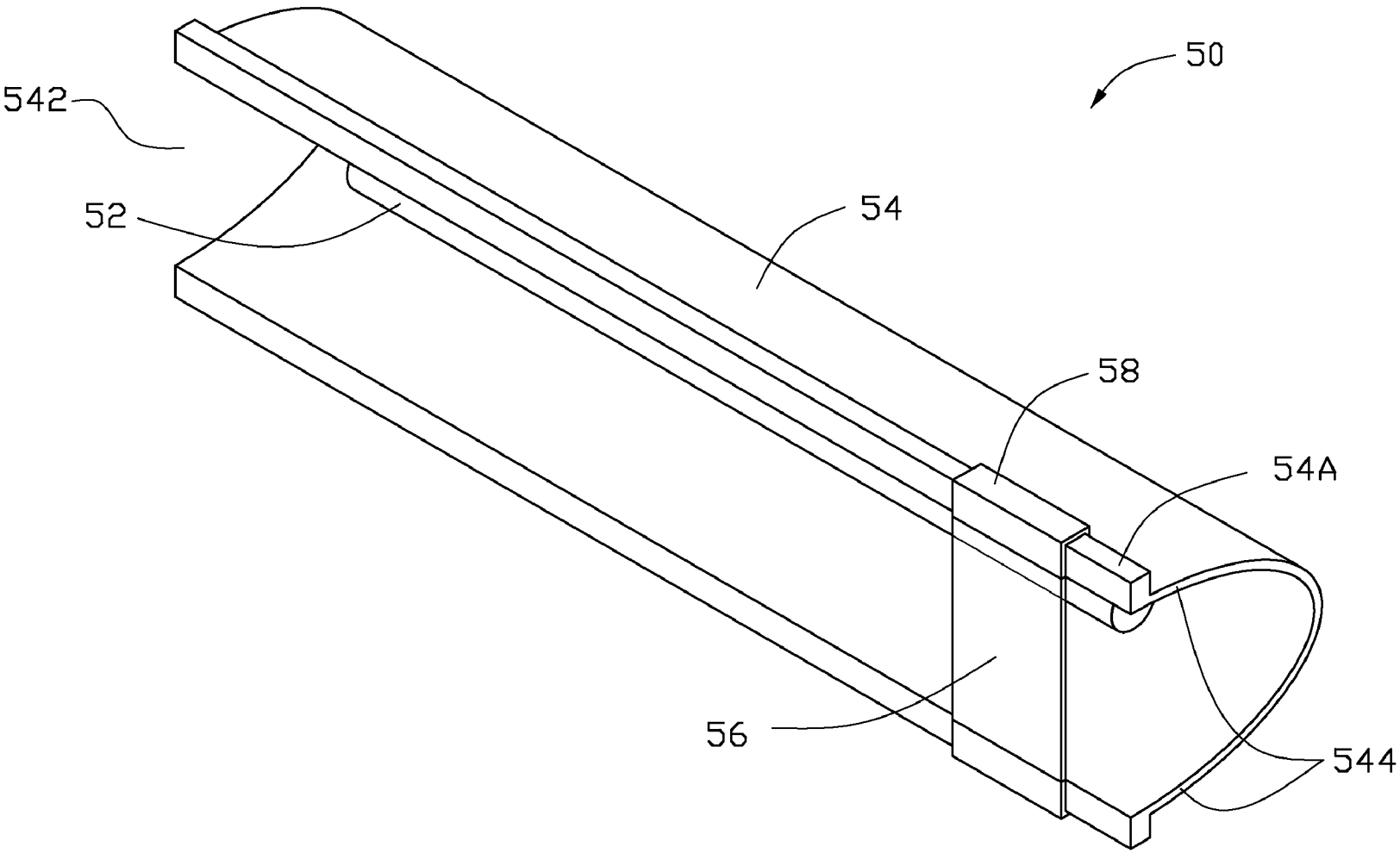
FIG. 5 is an isometric view of a fourth embodiment of an indoor lamp.

FIG. 5 is a schematic, isometric view of an indoor lamp 40 of a fourth exemplary embodiment. The indoor lamp 40 differs from the indoor lamp 10 as follows:

A shade 54 and a light source 52 of the indoor lamp 50 have elongated structures. The shade 54 has a generally U-shaped cross section, with two elongated free ends 544. In the illustrated embodiment, the shade 54 has a generally semi-elliptical cross section. An elongated rectangular opening 542 is defined between the two free ends 544. Two straight flange portions 54A are formed on an outer wall of the shade 54 at the two free ends 544, respectively. The flange portions 54A are parallel with each other, and extend from the two free ends 544 in opposite directions away from each other. Two hooked members 58 are connected with two opposite ends of a flat optical sheet 56, respectively. The hooked members 58 are slidably connected with the two flange portions 54A, respectively, in a manner similar to that of the hooked member 162 slidably connecting with the flange portion 14A. However, the hooked members 58 are straight along lengths thereof that are parallel to the flange portions 54A. With this arrangement, the optical sheet 56 is parallel to and faces the opening 542. A transverse width of the optical sheet 56 measured parallel to a longitudinal axis of the opening 542 is less than a corresponding length of the opening 542.

Figure 6:
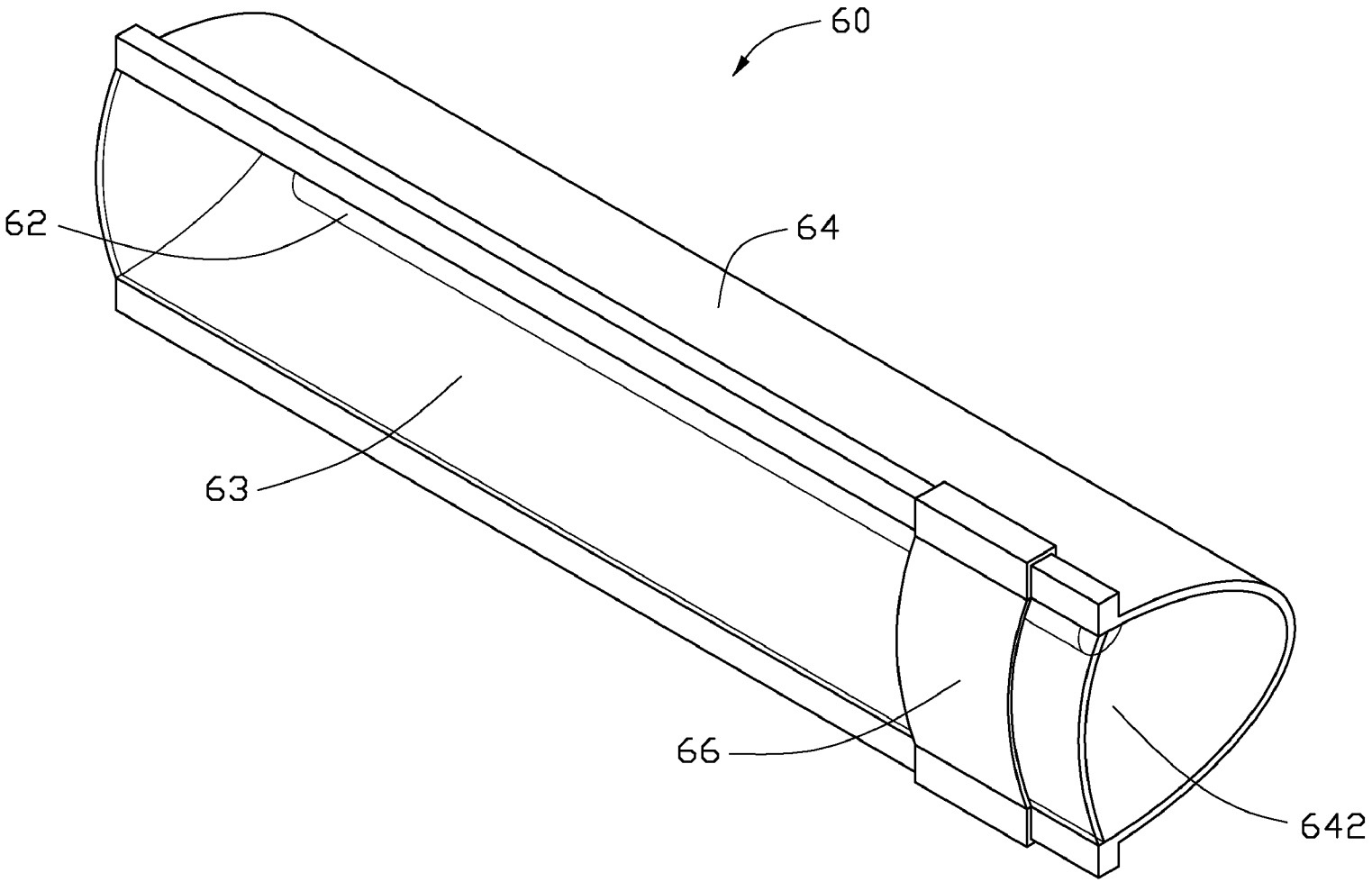
FIG. 6 is an isometric view of a fifth embodiment of an indoor lamp.

Referring to FIG. 6, this shows an indoor lamp 60 of a fifth exemplary embodiment. The indoor lamp 60 differs from the indoor lamp 50 as follows. The indoor lamp 60 further includes a light-pervious cover 63 connected with a shade 64. The light-pervious cover 63 is between a curved optical sheet 66 and a light source 62. The light-pervious cover 63 covers an entire elongated, rectangular opening 642, and has a curved cross section matching that of the optical sheet 66. In the illustrated embodiment, both the light-pervious cover 63 and the optical sheet 66 are curved convexly, and the optical sheet 66 slidably abuts but is spaced from an outer surface of the light-pervious cover 63.

Figure 7:
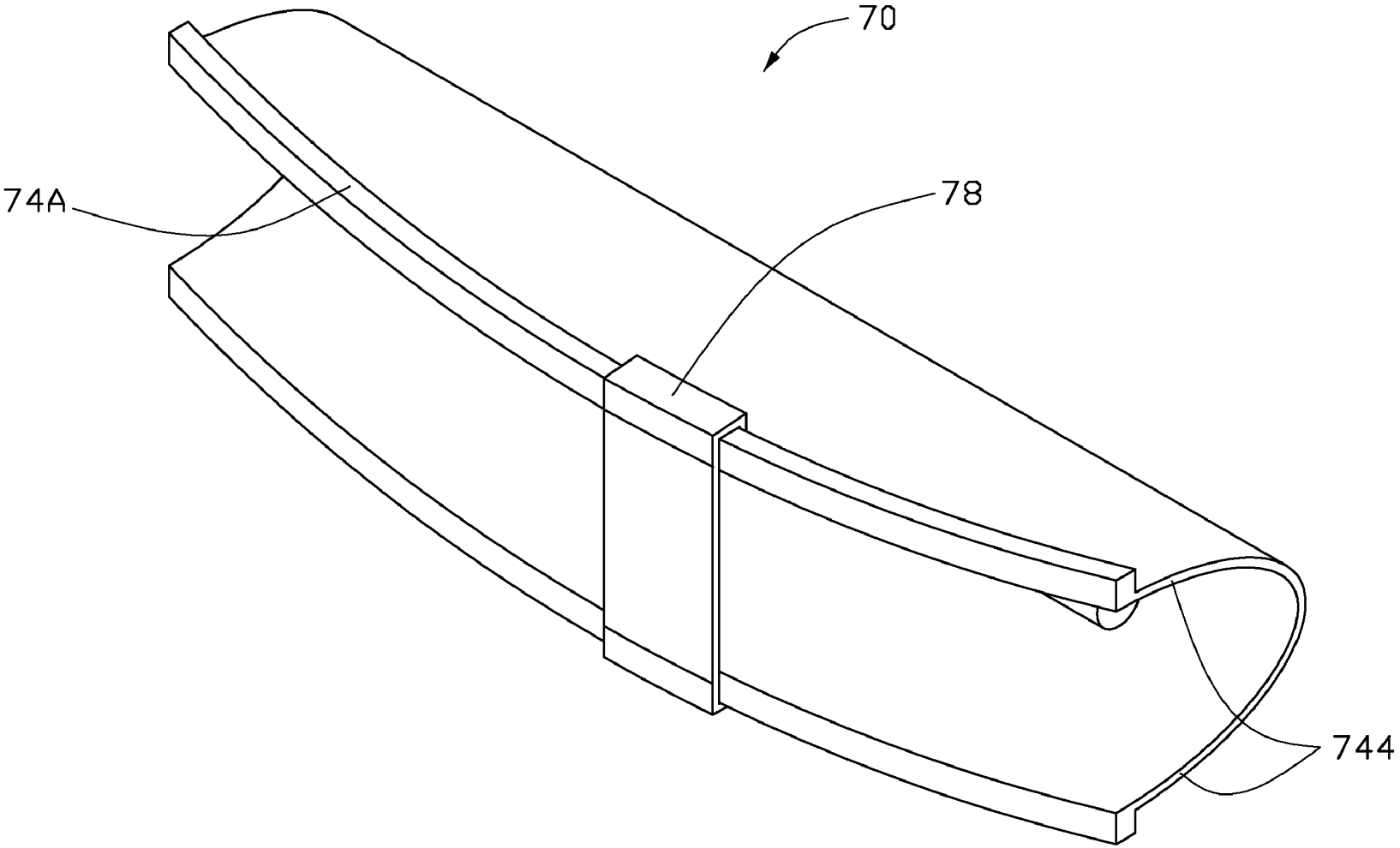
FIG. 7 is an isometric view of a sixth embodiment of an indoor lamp.

Referring to FIG. 7, this shows an indoor lamp 70 of a sixth exemplary embodiment. The indoor lamp 70 differs from the indoor lamp 50 in that two elongated flange portions 74A are curved along respective lengths thereof. In the illustrated embodiment, the curvature of each elongated flange portions 74A is an arc shape. Each of two hooked members 78 is curved along a length thereof that corresponds to a length of the respective flange portion 74A, with the curvature of the hooked member 78 matching the curvature of the flange portion 74A.

It is believed that the present embodiments and their advantages will be understood from the foregoing description, and it will be apparent that various changes may be made thereto without departing from the spirit and scope of the disclosure or sacrificing all of its material advantages, the examples hereinbefore described merely being preferred or exemplary embodiments of the disclosure.

What is claimed is:

1. An indoor lamp comprising:

a shade defining a receiving cavity therein and an opening at the bottom of the receiving cavity;

a light source received in the receiving cavity and positioned to emit light toward the opening; and an optical sheet facing the opening and sized to cover only part of the opening, the optical sheet being configured for reducing brightness of the light passing therethrough, and being movable to cover a selected part of the opening.

2. The indoor lamp of claim 1, further comprising at least one flange portion formed on an outer side of a bottom end of the shade, and at least one hooked member slidably engaging with the at least one flange portion, wherein the optical sheet is connected with the at least one hooked member.

3. The indoor lamp of claim 2, wherein the at least one hooked member comprises a generally U-shaped portion and a connection portion, the U-shaped portion extending from one side of the connection portion, the U-shaped portion being slidably engaging with the at least one flange portion, and the connection portion being connected with the optical sheet.

4. The indoor lamp of claim 3, wherein the shade is generally dome-like in shape, and tapers in profile from bottom to top, the opening is round, and the at least one flange portion is a single flange portion which is round and surrounds the opening.

5. The indoor lamp of claim 1, wherein the indoor lamp further comprises a light-pervious cover, the opening is round, the light-pervious cover has a circumference substantially the same as that of the opening, the light-pervious cover is configured for optically adjusting directions of light emitted from the light source thereby adjusting an illumination scope of the light source, a wall of the shade at the opening and the light-pervious cover abut each other with an interface therebetween being sealed, and the optical sheet is detachably attached to a bottom surface of the light-pervious cover.

6. The indoor lamp of claim 5, wherein the light-pervious cover is in the form of a meniscus lens that converges paths of light emitted from the light source.

7. The indoor lamp of claim 2, wherein the shade is elongated with a generally U-shaped cross section, the shade has two elongated free ends, the opening is defined between the two free ends and is elongated and substantially rectangular, the at least one flange portion is two straight flange portions, which are formed on an outer wall of the shade at the two free ends, respectively, the at least one hooked member is two hooked members, which are slidably connected with the two flange portions, respectively, and the two hooked members are connected with two opposite sides of the optical sheet, respectively.

8. The indoor lamp of claim 7, further comprising a light-pervious cover covering the elongated, substantially rectangular opening and being between the light source and the optical sheet, wherein the optical sheet slidably abuts but is spaced from an outer surface of the light-pervious cover.

9. The indoor lamp of claim 8, wherein the light-pervious cover has a curved cross section, and the optical sheet has a curved cross section matching that of the light-pervious cover.

10. The indoor lamp of claim 2, wherein the shade is elongated with a generally U-shaped cross section, the shade has two elongated free ends, the opening is defined between the two free ends and is elongated, the at least one flange portion is two flange portions, which are formed on an outer wall of the shade at the two free ends, respectively, each of the flange portions is curved along a length thereof, the at least one hooked member is two hooked members, which are slidably connected with the two flange portions, respectively, each of the hooked members is curved along a length thereof that corresponds to a length of the respective flange portion, with the curvature of the hooked member matching the curvature of the flange portion, and the two hooked members are connected with two opposite sides of the optical sheet, respectively.

11. The indoor lamp of claim 1, wherein the optical sheet is selected from the group consisting of a diffuser, a reflector and a light filter.

12. The indoor lamp of claim 11, wherein the optical sheet is a diffuser, and the diffuser is one of a neutral density filter and a light pass filter.

13. The indoor lamp of claim 1, wherein the optical sheet comprises a bottom, and the bottom of the optical sheet comprises a plurality of parallel prisms configured for refracting the light emitted from the light source such that the optical sheet causes the light to be deflected from its original paths.

14. The indoor lamp of claim 1, wherein the light source is one of a light emitting diode (LED) and an array of LEDs.

15. An indoor lamp, comprising:

a shade defining a receiving cavity therein and an opening at the bottom of the receiving cavity, at least one flange portion being formed on an outer side of a bottom end of the shade;

a light source received in the receiving cavity and positioned to emit light toward the opening;

at least one hooked member slidably engaged with the at least one flange portion; and an optical sheet connected with the at least one hooked member, the optical sheet facing the opening and sized to cover only part of the opening, the optical sheet being configured for reducing brightness of the light passing therethrough, and being movable in unison with the at least one hooked member to cover a selected part of the opening.

16. The indoor lamp of claim 15, wherein the at least one hooked member comprises a generally U-shaped portion and a connection portion, the U-shaped portion extending from one side of the connection portion, the U-shaped portion being slidably engaging with the at least one flange portion, and the connection portion being connected with the optical sheet.

17. The indoor lamp of claim 16, wherein the optical sheet comprises a bottom, and the bottom of the optical sheet comprises a plurality of parallel prisms configured for refracting the light emitted from the light source such that the optical sheet causes the light to be deflected from its original paths.

18. The indoor lamp of claim 16, wherein the shade is elongated with a generally U-shaped cross section, the shade has two elongated free ends, the opening is defined between the two free ends and is elongated and substantially rectangular, the at least one flange portion is two straight flange portions, which are formed on an outer wall of the shade at the two free ends, respectively, the at least one hooked member is two hooked members, which are slidably connected with the two flange portions, respectively, and the two hooked members are connected with two opposite sides of the optical sheet, respectively.

19. The indoor lamp of claim 16, wherein the shade is elongated with a generally U-shaped cross section, the shade has two elongated free ends, the opening is defined between the two free ends and is elongated, the at least one flange portion is two flange portions, which are formed on an outer wall of the shade at the two free ends, respectively, each of the flange portions is curved along a length thereof, the at least one hooked member is two hooked members, which are slidably connected with the two flange portions, respectively, each of the hooked members is curved along a length thereof that corresponds to a length of the respective flange portion, with the curvature of the hooked member matching the curvature of the flange portion, and the two hooked members are connected with two opposite sides of the optical sheet, respectively.

* * * * *